US006024156A

United States Patent [19]

Chu

[11] Patent Number: 6,024,156

[45] Date of Patent: Feb. 15, 2000

[54] CURTAIN DRAWING APPARATUS

[75] Inventor: Winston Chu, Arcadia, Calif.

[73] Assignee: Marikon Resources, Inc., Arcadia, Calif.

[21] Appl. No.: 09/166,644

[22] Filed: Oct. 5, 1998

[51] Int. Cl.[7] ..... A47H 5/06

[52] U.S. Cl. ..... 160/331; 160/343; 160/7

[58] Field of Search ..... 160/331, 343, 160/123, 126, 1, 5, 7

[56] References Cited

U.S. PATENT DOCUMENTS

| | | | |
|---|---|---|---|
| 1,823,909 | 9/1931 | Meier | 160/343 |
| 1,954,941 | 4/1934 | Monnier | 160/343 |
| 2,801,690 | 8/1957 | Bennett | 160/343 |
| 3,003,552 | 10/1961 | Eilenberger | 160/343 X |
| 3,045,747 | 7/1962 | Hill | 160/331 |
| 3,208,507 | 9/1965 | Breen | 160/343 |
| 3,774,665 | 11/1973 | Bourne | 160/343 |
| 4,023,609 | 5/1977 | Rosenquist | 160/343 |
| 4,131,831 | 12/1978 | Bochenek et al. | 160/331 X |
| 4,610,294 | 9/1986 | Anesi et al. | 160/331 |
| 4,819,708 | 4/1989 | Onosato et al. . | |
| 4,832,104 | 5/1989 | De Labarthe et al. | 160/343 |
| 4,850,415 | 7/1989 | Rometsch . | |
| 4,926,922 | 5/1990 | Shimazaki . | |
| 4,958,112 | 9/1990 | Zerillo . | |
| 4,965,498 | 10/1990 | Yokota . | |
| 4,995,442 | 2/1991 | Marzec . | |
| 5,270,629 | 12/1993 | Hsieh . | |
| 5,371,447 | 12/1994 | Boss . | |

*Primary Examiner*—David M. Purol
*Attorney, Agent, or Firm*—James E. Brunton

[57] ABSTRACT

A fully automatic motor driven curtain drawing apparatus which is of a simple, but highly reliable design and one which can be easily adjusted to accommodate windows of widely differing sizes. They can be opened either manually or by an electric motor which can be remotely energized. A timer and a sensor are operably connected to the electric motor and function to energize the motor either at a predetermined time or in response to the sensor sensing daylight and dark.

16 Claims, 7 Drawing Sheets

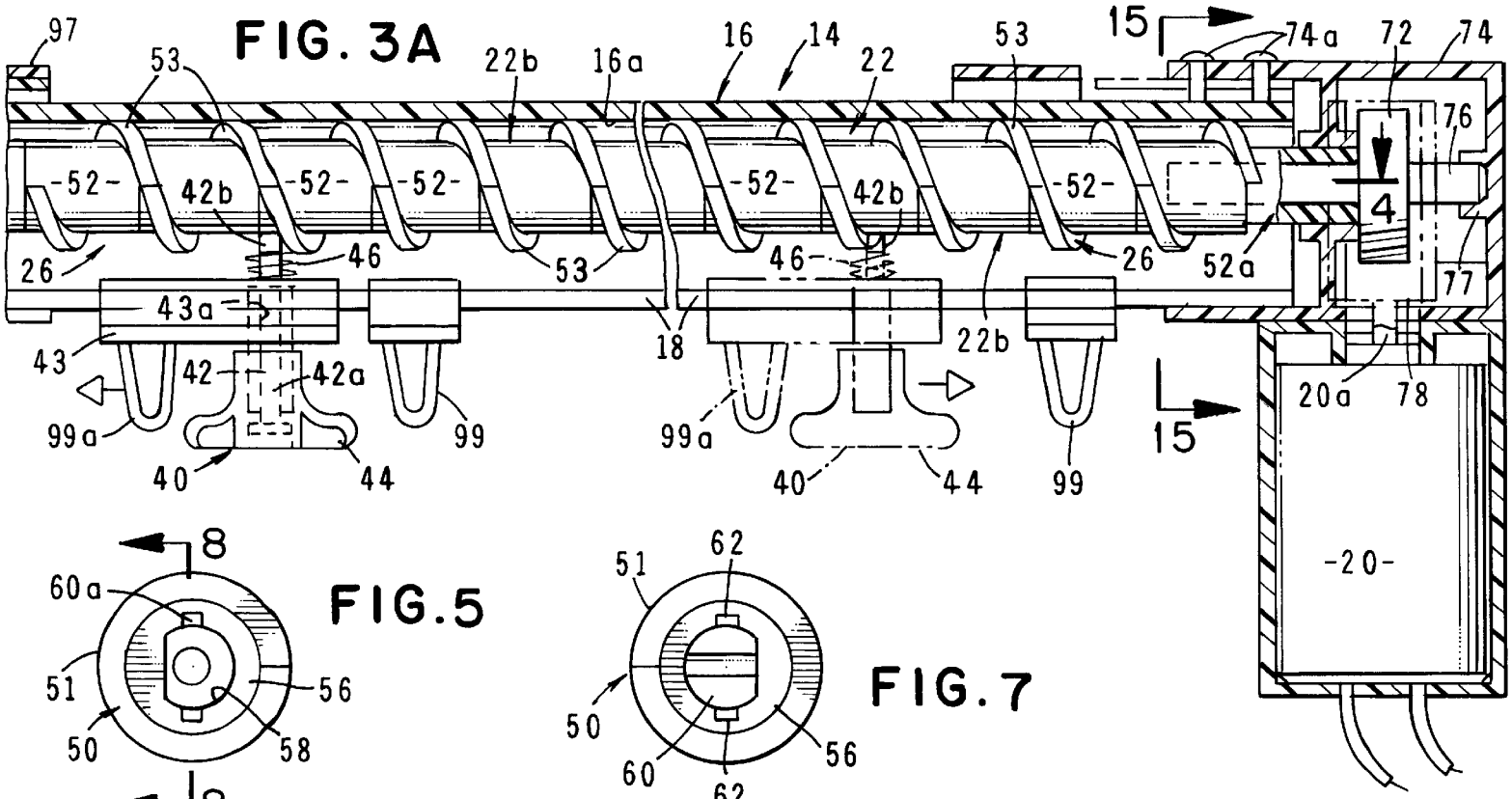
FIG. 3A
FIG. 7
FIG. 5
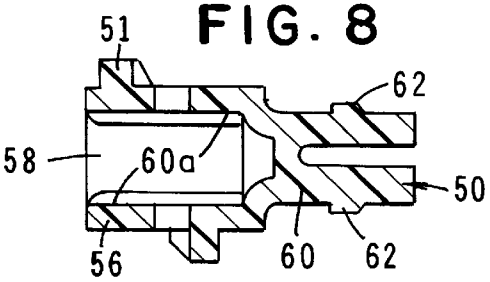
FIG. 8
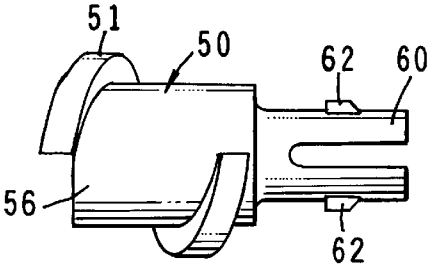
FIG. 6

CURTAIN DRAWING APPARATUS

BACKGROUND OF THE INVENTION

1. Field of the Invention

The present invention relates generally to curtain drawing devices. More particularly, the invention concerns an apparatus of novel design having an elongated rod assembly made up of cooperating sections each having a spiral formed thereon which engages and controllably moves a plurality of curtain connectors along a track as the rod assembly is controllably rotated.

2. Discussion of the Prior Art

A very large number of different types of curtain drawing devices have been suggested in the past. Many of these prior art devices are operable both manually as well as by small electric motors some of which can be remotely controlled.

Various types of drive mechanism have been suggested for operably inter-connecting the electric motor with the curtain drawing apparatus. For example, pulley and cable systems have been suggested as well as a number of different types of gearing mechanisms, such as a rack and pinion and worm screw rack mechanisms. A drawback of many of the prior art devices is that because of their complexity of design they are expensive to manufacture, are expensive to maintain and tend to be unreliable in operation. Another drawback of many of the prior art devices is that they must be custom made to fit each window thereby adding to their cost.

Exemplary of one type of prior art curtain drawing device, which can be operated both manually and automatically, is the device disclosed in U.S. Pat. No. 4,926,922 issued to Shimazaki. The Shimazaki device comprises an electric motor, a curtain rod which is driven rotatably by the motor, a longitudinally-extending spiral element attached to the outer circumference of the curtain rod and a plurality of rings through which the curtain rod passes. Each of the rings has a diameter larger than the diameter of the curtain rod, so that the curtain, which is suspended from the rings, can be drawn either manually or by rotation of the curtain rod. An automatically-releasing tassel holder which can be operated by remote control is also disclosed by Shimazaki.

The thrust of the present invention is to provide a novel apparatus that overcomes many of the drawbacks of the prior art devices by providing a fully automatic motor driven apparatus which is of simple, but highly reliable design and one which can be easily adjusted to accommodate windows of widely differing sizes.

SUMMARY OF THE INVENTION

It is an object of the device to provide a fully automatic curtain drawing apparatus which is of simple design, is highly reliable in operation and is readily adjustable to fit windows of various sizes.

Another object of the invention is to provide an apparatus of the aforementioned character which can be operated either manually or by an electric motor which can be remotely energized.

Another object of the invention is to provide an apparatus of the type described in the preceding paragraph which also induces a timer and a sensor which are operably connected to the electric motor and finction to energize the motor either at a predetermined time or in response to the sensor sensing daylight and dark.

Another object of the inventions to provide a curtain drawing apparatus of the class described in which the rotating parts of the apparatus are safely enclosed within an attractive valance.

Another object of the invention is to provide an apparatus as described in the preceding paragraphs which can be inexpensively produced and easily installed by nonprofessional installers.

BRIEF DESCRIPTION OF THE DRAWINGS

FIGS. 3 and 3A, when taken together, comprise an enlarged, cross-sectional view taken along lines 3—3 of FIG. 2.

FIG. 5 is an end view of one element of a plurality of elements which are interconnected together to form a portion of the drive rod of the apparatus shown in FIG. 4.

FIG. 6 is a side-elevational view of the element shown in FIG. 5.

FIG. 7 is a right-end view of the element shown in FIG. 6.

FIG. 8 is a cross-sectional view taken along lines 8—8 of FIG. 5.

DESCRIPTION OF THE INVENTION

Figure 1:
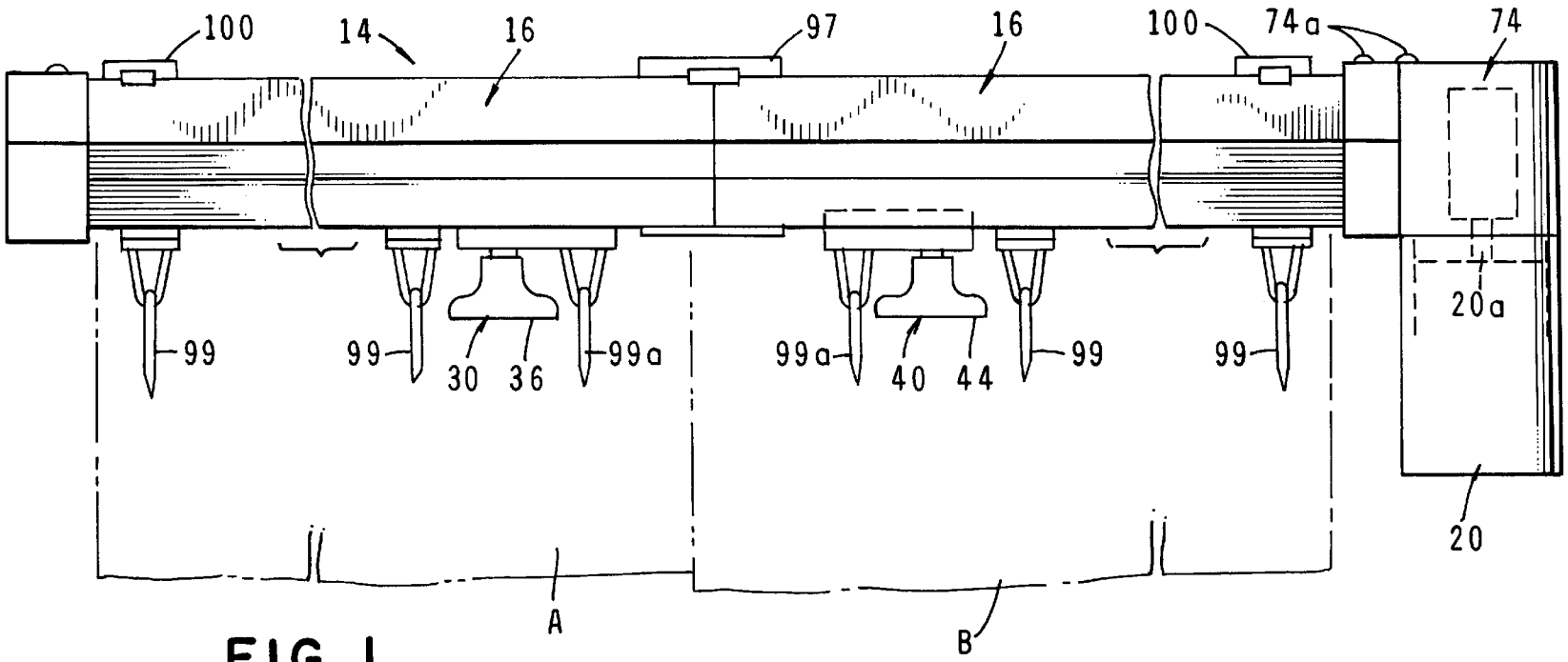
FIG. 1 is a front view of one form of the apparatus of the invention.
Figure 2:
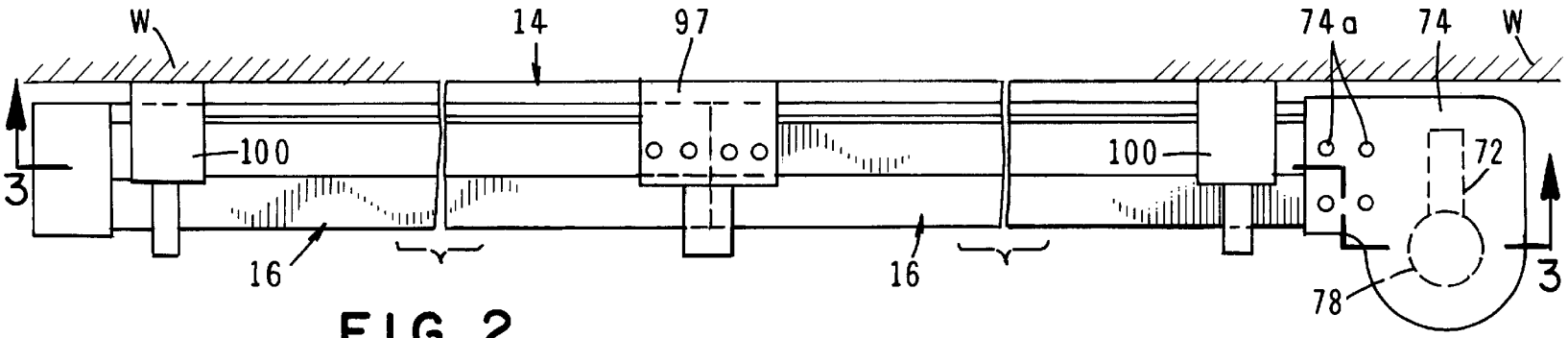
FIG. 2 is a top plan view of the apparatus shown in FIG. 1.
Figure 3:
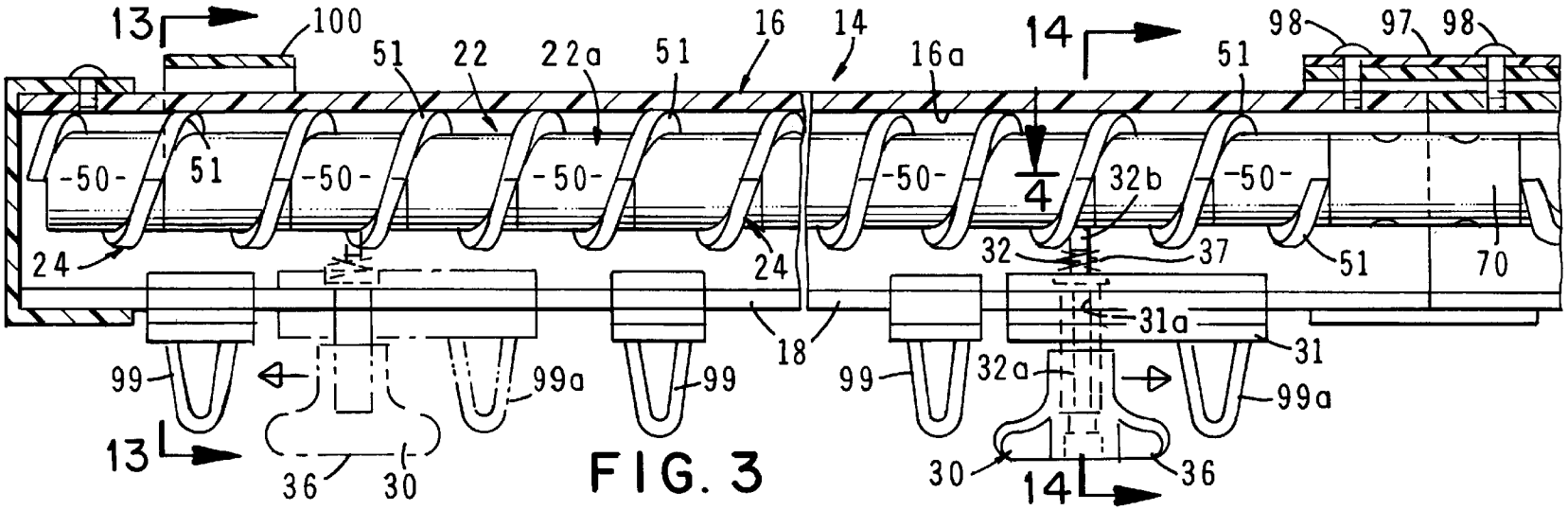
Figure 17:
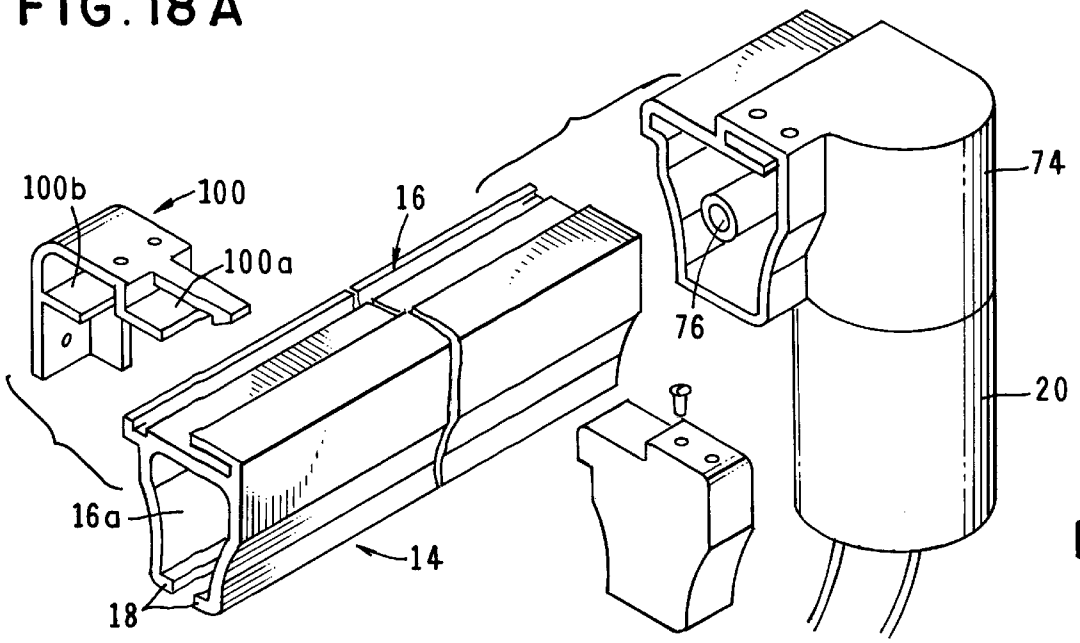
FIG. 17 is a generally perspective, exploded view of the drive end of the apparatus of the invention shown in FIG. 1.

Referring to the drawings and particularly to FIGS. 1 through 4, one form of the apparatus of the invention for drawing together first and second curtain panels A and B (FIG. 1) is there shown. In this form of the invention the apparatus comprises an elongated support 14 which includes a hollow housing, 16 having an elongated internal chamber 16*a* and an elongated track 18. (FIGS. 3, 3*a* and 17).

An electric motor 20 is connected to the support and an elongated operating assembly 22 is connected to the electric motor for rotation thereby. Operating assembly 22 includes a first section 22*a* (FIG. 3), and a second cooperatively interconnected section 22*b* (FIG. 3*a*), both of which are disposed within the elongated internal chamber 16*a* of housing 16. First section 22*a* is provided with a right hand spiral 24 about its periphery while second section 24*b* is provided with a left hand spiral 26 about its periphery.

Figure 14:
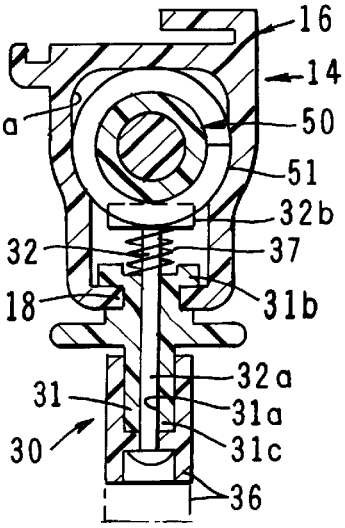
FIG. 14 is a cross-sectional view taken along lines 14—14 of FIG. 3.

A first carrier means for interconnection with first curtain panel "A" comprises a first carrier assembly 30 (FIG. 3) which is slidably connected to elongated track 18 for longitudinal sliding movement there along. First carrier assembly 30 comprises a body 31 having a bore 31*a* for slidably receiving a spiral engaging finger 32 which includes a shank portion 32*a* and a head portion 32*b* which is positioned for engagement with spiral 24 of first section 22*a*. Body 31 includes an upper track engaging portion 31*b* and a lower portion 31*c* (FIG. 14). First carrier assembly 30 also comprises a finger operated means shown here as a finger grip segment 36 for use in moving head portion 32*b* of finger 32 against the urging of a biasing means between a first position and a second position wherein said head portion 32*b* is out of engagement with spiral 24. In the present form of the invention, this biasing means is provided as a coil spring 37.

A second carrier means of similar construction to first carrier means 30 interconnects with second curtain panel 20 and comprises a second carrier assembly 40 (FIG. 3A), which includes a spiral engaging finger 42 having a shank portion 42*a* carried within a bore 43*a* formed in a body 43 and a head portion 42*b* which is positioned for engagement with spiral 26 of second section 22*b*. Once again, finger operating means are provided for moving head portion 42 out of engagement with spiral 26 of second section 22*b*. This finger operating means here comprises a finger gripping segment 44 which can be gripped by the user to exert a downward force on finger 42 against the urging of a biasing means here provided as a coil spring 46 which fimctions to normally maintain head portion 42*b* of finger 42 in engagement with spiral 26.

Forming an important part of the apparatus of the present form of the invention is control means for energizing and de-energizing electric motor 20. The details of construction and operation of this important control means will presently be described.

Figure 12:
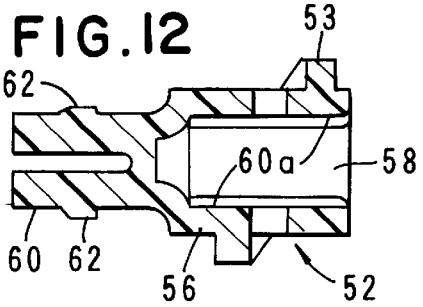
FIG. 12 is a cross-sectional view taken along lines 12—12 of FIG. 11.
Figure 15:
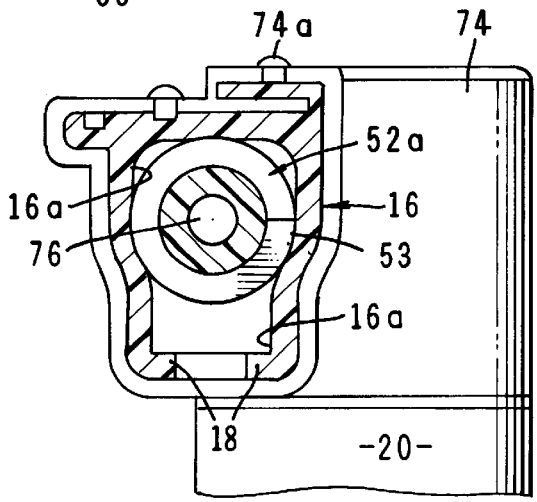
FIG. 15 is a cross-sectional view taken along lines 15—15 of FIG. 3A.

Referring next to FIGS. 4 through 12, it is to be noted that each of the first and second sections 22*a* and 22*b* of the operating assembly comprise a plurality of interconnected individual segments. The segments which make up section 22*a* are of the configuration shown in FIGS. 5 through 8, while the segments which make up second section 22*b* are of the configuration shown in FIGS. 9 through 12. These segments are all of a similar configuration save for the fact that the helix or spiral 51 formed on the segments of section 22*a* are right hand while the helix or spiral 53 formed on the segments of section 22*b* are left hand. The segments which make up first section 22*a* are generally designated in the drawings by the numeral 50 while the segments which make up the second section 22*b* are generally designated by the numeral 52. Each of the segments 50 and 52 comprise a generally cylindrically shaped body portion 56 having a central counter bore 58 formed therein which has a flat formed on one side thereof (FIGS. 8 and 12). Each of the segments also include a neck portion 60 having a flat formed thereon and includes circumferentially spaced apart spine-like locking elements 62 formed thereon. These various segments 50 and 52 are interconnected together in the manner shown in FIGS. 3 and 4 to form the elongated first and second sections 22*a* and 22*b* of the operating assembly. More particularly, the forward portion of each of the segments is inserted into the counter bore of the adjacent segment with the flats in engagement and the locking members of the segment being received within longitudinally extending grooves 60*a* formed in the walls of counter bore 58 (FIG. 7). With this construction, each of the segments will be rotated by its adjacent segment as end segment 60*a* (FIG. 3A) of drive assembly 22*b* is driven by motor 20. In this regard, by referring to FIG. 3, it can be seen that assemblies 22*a* and 22*b* are interconnected by interconnection means here shown as a connecting sleeve assembly 70, the details of construction of which will be presently be described.

Figure 4:
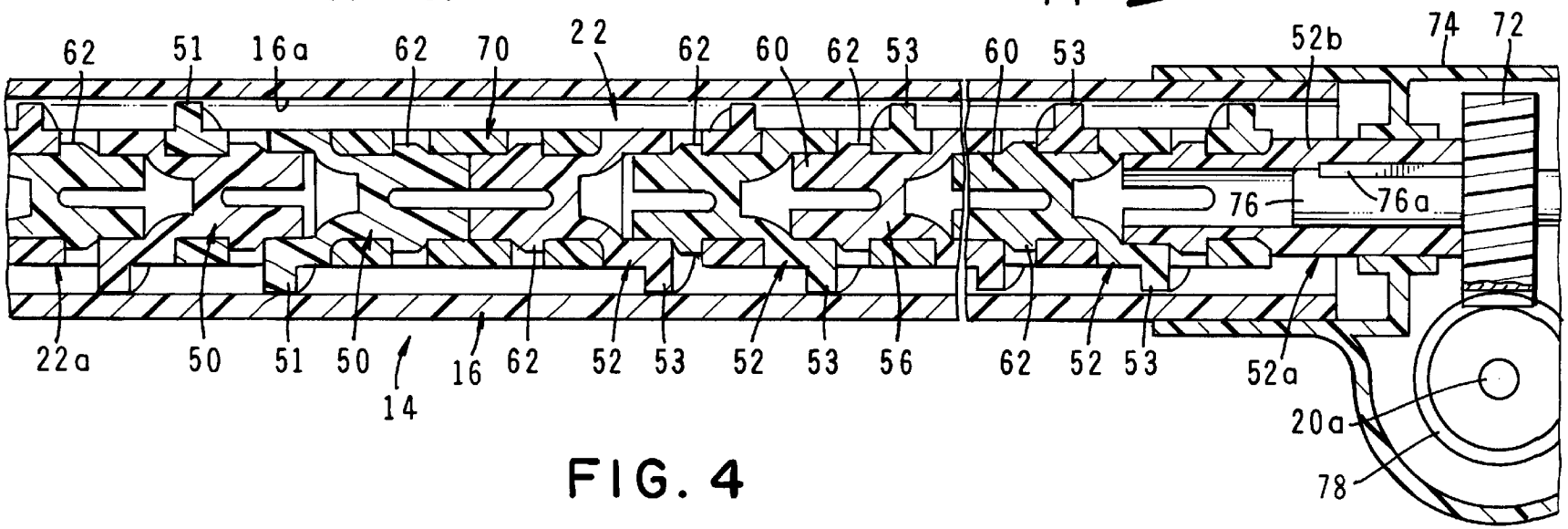
FIG. 4 is a cross-sectional view taken along lines 4—4 of FIGS. 3 and 3A.
Figure 9:
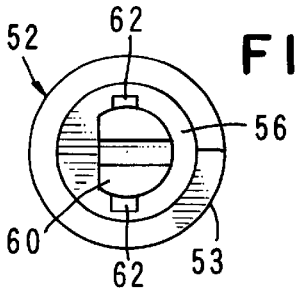
FIG. 9 is an end view of one of a plurality of element which are interconnected to form another portion of the drive rod of the apparatus of the invention.
Figure 10:
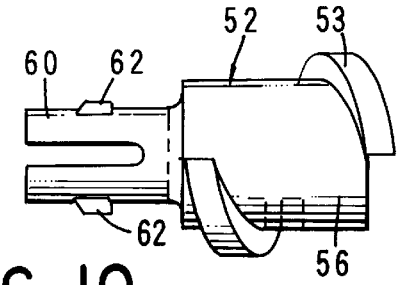
FIG. 10 is a side-elevational view of the element shown in FIG. 9.
Figure 11:
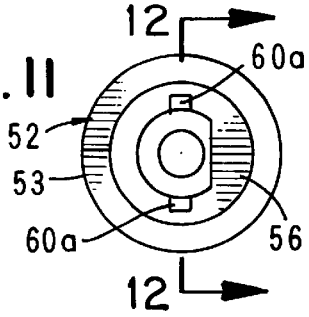
FIG. 11 is a right-end view of the element shown in FIG. 10.

Referring particularly to FIGS. 3A and 4, it is to be noted that a driven wheel 72 is rotatably mounted within a hollow housing 74 which is suitably connected to the right end of housing 16 by connectors 74*a* (FIG. 3A). Driven wheel 72 is mounted on a shaft 76 the outboard end of which is disposed within a bearing 77 provided on housing 74. The elongated inboard end of the shaft is interconnected with drive assembly 22*b* in the manner shown in FIG. 3A. This construction, rotation of driven wheel 72 by a driving wheel 78 will impart rotation to assembly 22*b* and, via connector assembly 70, to assembly 22*a*.

As shown in FIG. 4, drive wheel 78 is controllably driven by the shaft 20*a* of motor 20 when the motor is energized by the control means. With the construction thus described, it is apparent that the apparatus of the invention can be customized to fit windows of various sizes. More particularly, because of its segmented construction, the drive assembly can be tailored to any particular installation by selecting the proper number of segment 50 and 52 which, when interconnected together, will provide a drive assembly of a suitable length to cover the window opening at hand.

Figure 16:
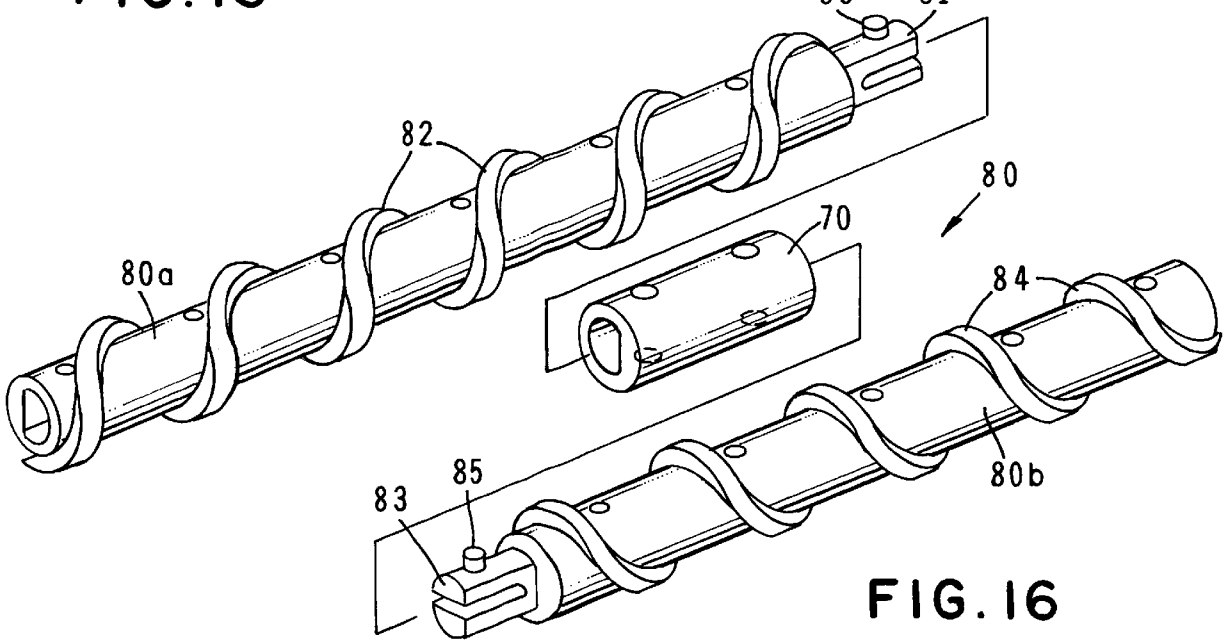
FIG. 16 is a generally perspective, exploded view of the two halves of an alternate form of drive rod of the apparatus of the invention.

Turning next to FIG. 16, an alternate form of the elongated operating assembly of the invention is there shown. This form of the invention can be used when the apparatus of the invention is to be installed to cover windows of a known, standard size so that the length of the operating assembly is known prior to installation. The alternate form of operating assembly is here generally designated by the numeral 80 and comprises a first section 80*a* and a second section 80*b*. The cooperating sections are interconnected by means of a connector assembly 70 of the character previously described. More particularly, the connector assembly comprises a generally tubular shaped sleeve having a bore which closely receives the inboard ends 81 and 83 of sections 80*a* and 80*b* respectively. Sections 80*a* and 80*b* are securely connected to the connector means or connector assembly 70 by suitable connectors 85. In this latest form of the invention, each of the sections 80*a* and 80*b* are of a continuous, one piece construction rather than being made up of a plurality of interconnected segments such as segments 50 and 52 of the earlier described embodiment. As before, section 80*a* includes a right hand spiral 82 while section 80*b* includes a left hand spiral 84. Section 80*a* and 80*b* are interconnected by a connector means identified in FIG. 16 by the numeral 70. Sections 80*a* and 80*b* are mounted within a housing 16 which is of identical construction to that previously described and the two operating assemblies are driven by electric motor 20 which is drivably interconnected with section 80*b* in the manner previously described.

Figure 18:
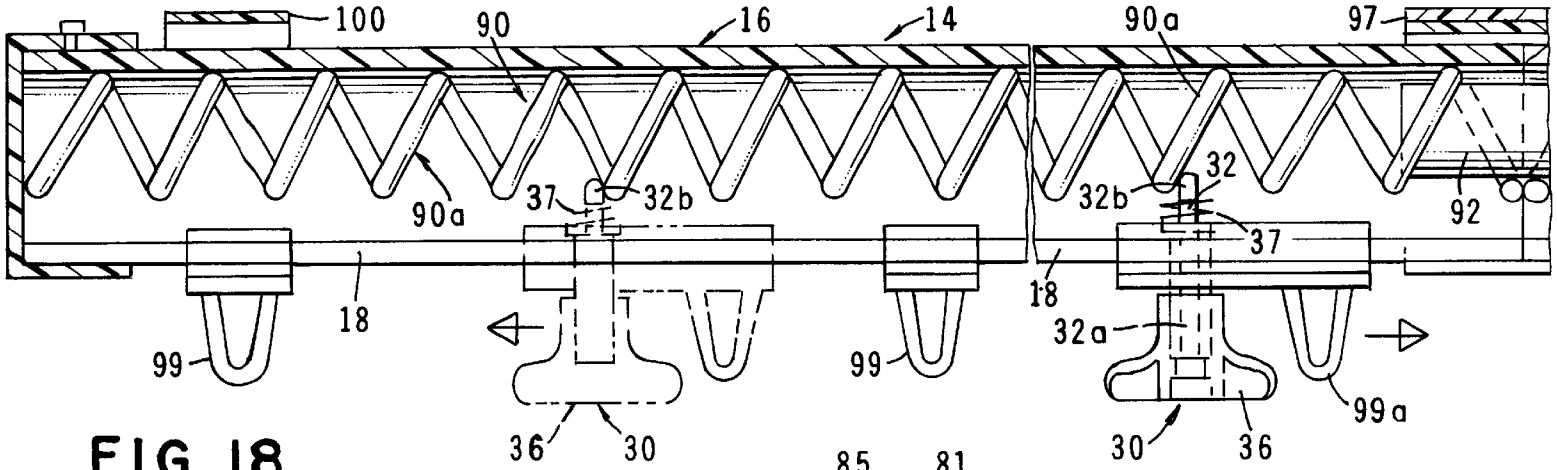
FIGS. 18 and 18A, when taken together, comprise a cross-sectional view of yet another alternate form of the apparatus of the invention.
Figure 18A:
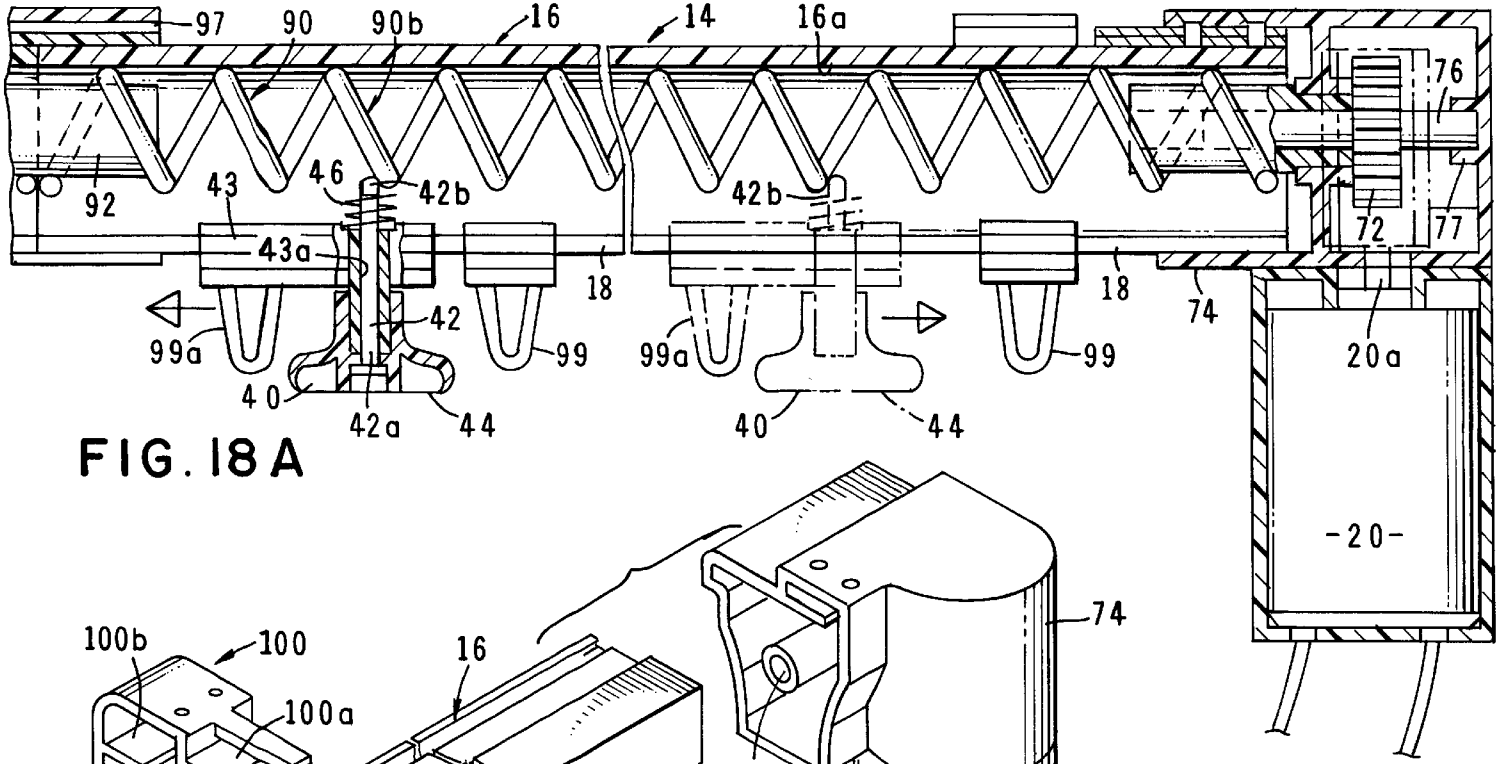

Referring next to FIGS. 18 and 18A, yet another form of the elongated operating assembly of the invention is there shown. This form of the invention is also used when the apparatus of the invention is to cover windows of a known standard size so that the required length of the operating assembly is known beforehand. The elongated operating assembly of this latest form of the invention, which is generally designated in the drawings by the numeral 90, comprises an elongated, substantially rigid metal spiral having first and second sections 90*a* and 90*b*. Sections 90*a* and 90*b* are connected by a connector rod 92 the ends of which are closely received within the open inboard ends of the spiral sections in the manner shown in FIGS. 18 and 18A. As before, spiral section 90*a* is formed in a right hand spiral, while section 90*b* is formed in a left hand spiral. Metal spiral 90 is mounted within housing 16 which is of identical construction to that previously described and includes an elongated track 18.

This latest embodiment of the invention also includes first and second carrier means which are of the same general construction as previously described and which function to move curtains, such as curtains A and B between open and closed positions. As before, first carrier means or carrier assembly 30 comprises a spiral engaging finger 32 which includes a shank portion 32*a* and a head portion 32*b* that is strategically positioned for engagement with the metal spiral of first section 90*a* in the manner shown in FIG. 18. As before, carrier assembly 30 also comprises a finger operated means shown here as a finger grip segment 36 for use in moving head portion 32*b* of finger 32 out of engagement with spiral 90*a* against the urging of a biasing means here provided as a coil spring 37.

A second carrier means, or carrier assembly 40, also includes a spiral engaging finger 42 having a shank portion 42*a* and a head portion 42*b* which is positioned for engagement with spiral 90*b* of the metal spiral 90 (FIG. 18A). Once again, finger operating means are provided for moving head portion 42 out of engagement with spiral 90*b* so that carrier means can be freely moved longitudinally of housing 16. As before, this finger operating means comprises a finger gripping segment 44 which can be gripped by the user to exert a downward force on finger 42 against the urging of a biasing means such as a coil spring 46 which functions to normally maintain head portion 42*b* of finger 42 in engagement with spiral 90*b*.

In installing the various forms of the apparatus of the present invention, the size of the window opening is first determined. If the size is standard, operating assemblies of the character shown in FIGS. 16, 18 and 18A can be used. More particularly, if the size is standard, sections 80*a* and 80*b* of the continuous rod type drive assembly shown in FIG. 16 can be selected before hand so that when the sections are interconnected together using the connector 70, the drive assembly will have a total length substantially equal to the window opening or the combined lengths of window coverings A and B (FIG. 1). Similarly, if the metal spiral-type drive assembly of the character shown in FIGS. 18 and 18*a* is to be used, sections 90*a* and 90*b* can be selected so that when interconnected together using connector 92, their total length will approximate the length of the window opening.

When the window opening is non-standard, drive assemblies of the character shown in FIGS. 1 through 15 are used. In this instance, the window opening is divided in half and an appropriate number of segments 50 are interconnected together in the manner previously described to form a section 22*a* which has a length equal to approximately one-half the window opening. In a similar manner, an appropriate number of segments 52 are selected and interconnected together to form a section 22*b* which also has a length equal to approximating one-half the window opening.

After the operating assemblies have been selected, the next step in the method of the invention is to fabricate the first and second halves of the support structure or housing 16 so that, when the halves are interconnected together using a connector assembly 97 of the character shown in FIGS. 3 and 3A, the overall length of the housing will approximate the length of the window opening. As best seen in FIG. 3, the first and second halves of the housing 16 are preferably connected together using connector assembly 97 and appropriate threaded connectors 98 which can be threadably connected to the upper wall of the housing.

Following the construction of housing 16, drive 74 is suitably interconnected with the right hand end of the housing as viewed in FIG. 3A and operating assembly 22 is interconnected with shaft 76 in the manner shown in FIG. 3A so that upon rotation of the shaft by the electric motor, operating assembly 22*b* will also rotate. For this purpose, a specially configured segment 52*a* is used, which segment has an elongated, grooved connector section 52*b* that appropriately mates with a spline 76*a* provided on the inboard end of shaft 76 (see FIG. 4).

Either prior to or subsequent to the interconnection of the operating assembly with the drive assembly, the curtain connectors 98 and the first and second carrier means or carrier assemblies 30 and 40 are appropriately positioned within housing 16 by sliding them along track 18. Selective positioning of the first and second carrier means can readily be accomplished by pulling downwardly on the finger grips 36 and 44 so that the ends of the helix engaging fingers of the assemblies will clear the helix formed on the operating assembly and permit free movement of the assemblies along track 18.

Figure 13:
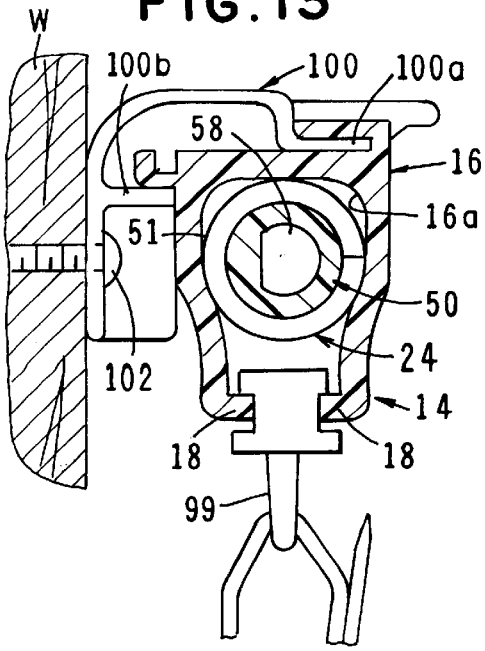
FIG. 13 is a cross-sectional view taken along lines 13—13 of FIG. 3.

Once housing 16, operating assemblies 22*a* and 22*b*, carrier assemblies 30 and 40 and the plurality of curtain connectors have been assembled together in the manner shown in FIGS. 3 and 3A, the apparatus thus formed can be connected to a wall "W" located adjacent the window opening by in any suitable manner such as is illustrated in FIG. 13. For this purpose, mounting brackets 100, which include connector fingers 100*a* and 100*b*, can be connected to wall "W" by appropriate fasteners such as screws 102. This done, housing 16 can be connected to the connector fingers 100*a* and 100*b* in the manner best seen in FIG. 13.

With the assembly appropriately mounted proximate the window opening, curtain panels A and B can be connected with the curtain connectors 99 and 99*a* in the manner shown in the drawings. In this regard, it is to be noted that curtain connectors, which are identified in the drawings by the numeral 99*a*, are affixed to body portions 31 and 43 respectfully of the carrier assemblies. Accordingly as the carrier assemblies are moved along the track 18 by the operating means, the curtains will also be smoothly drawn along the window opening.

With the assembly mounted proximate the window opening in the manner shown in FIGS. 1, 2, and 13, curtain panels A and B can be connected with the curtain connectors 99 and 99*a* in the manner shown in FIG. 1. When so connected the curtains will hang downwardly from the curtain connectors and, when the apparatus is moved into the curtain closing position, the curtains will span the window opening. Opening and closing of the curtain is, of course, accomplished using the control means of the invention to energize motor 20. More particularly, when motor 20 is energized in a manner to cause rotation of the operating assemblies in a first direction, the helixes formed on sections 22*a* and 22*b* will engage the finger end portions 22*b* and 42*b* respectively of the two carrier assemblies causing them to move either toward or away from one another. Obviously, as the carrier assemblies move, the curtain panels connected thereto will also move in either the first or second direction.

Figure 19:
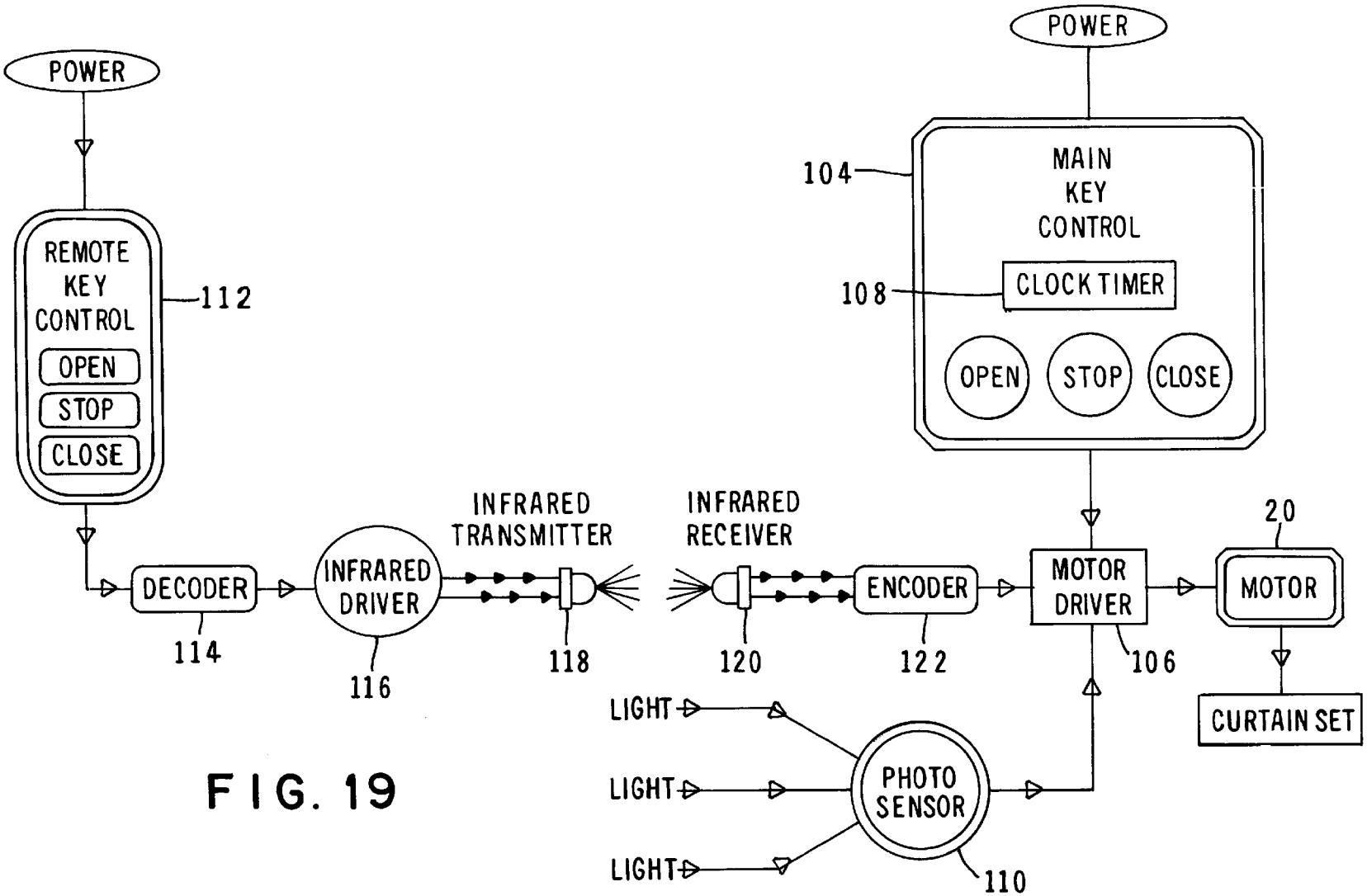
FIG. 19 is a generally schematic view of the control circuitry of the apparatus of the invention.

Referring to FIG. 19, one form of the control means of the invention is there shown and can be seen to comprise a main key-control operating panel 104 which is interconnected with the source of electric power. Main panel 104 is also operably interconnected with a motor driver 106 which, on command, functions to energize or de-energize motor 20. More particularly, by pushing the open button on main panel 104, the motor driver will cause the motor to rotate operating assembly 22 in a first, clockwise direction. As the operating assembly thusly rotates, the helixes 51 and 53 will engage the helix-engaging fingers of the two carrier means causing them to move away from the center of housing 16 and, at the same time, causing the curtains to move toward an open configuration. Similarly, when the close button is pushed, motor 20 will cause the operating assembly to rotate in a counterclockwise direction causing the two carrier assemblies to move toward the center of the housing and, in so doing, causing the curtains to move toward a closed configuration. A stop button is also provided on main panel 104 so that the operator can de-energize the motor at any time and stop rotation of the operating assembly. Also comprising a part of the drive means of the invention is a timer means shown here as a clock timer 108 of conventional construction which can be set by the operator to cause energization of the motor and the concomitant opening and closing of the curtain at a selected time of day as set on the clock timer. Also comprising a part of the drive means of the present form of the invention is sensor means for sensing light rays impinging upon the sensor. This sensor means is here provided in the form of a photosensor 110 which is of conventional construction and is readily available from a number of commercial sources. The photosensor is operably interconnected with the motor driver 106 and functions to energize motor 20 upon sensing light rays impinging on the photosensor 110. The timer, the sensor means and the driver are all readily commercially available and the circuitry involved in the operable interconnection of the various controls of main key control panel with the motor driver and the motor 20 is of a character well known to those skilled in the art so that the apparatus can be easily interconnected in the manner shown in FIG. 19 by those skilled in the art.

Also forming a part of the drive means of the apparatus of the present invention, is a remote key-control means for energizing the electric motor from a location remote to the electric motor. This remote control means comprises a remote key control panel 112 which is operably interconnected with the source of power and is also operably interconnected with a conventional decoder 114 which, in turn, is interconnected with an infrared driver 116 which finctions to drive a conventional infrared transmitter 118. Signals from infrared transmitter 118 are received by a conventional infrared receiver 120 which is interconnected with a conventional encoder 122 which, in turn, is interconnected with motor driver 106 to cause the motor driver to energize motor 20 upon the infrared receiver receiving infrared signals from the infrared transmitter.

The remote key-control panel 112, like the main key-control panel, includes manually operable buttons which will cause the curtains to open and close. Panel 112 also includes a stop button which will de-energize the motor on command at any time. The remote control means is of a character well understood by those skilled in the art and is readily commercially available from a number of sources. The construction of the remote control means and the interconnection of the components thereof in the manner shown in FIG. 19 is well within the skill of the art.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for drawing together first and second curtain panels comprising:

(a) an elongated subport including a housing having an elongated internal chamber and an elongated track;

(b) an electric motor connected to said support;

(c) an elongated operating assembly connected to said electric motor for rotation thereby, said operating assembly comprising:

(i) a first section disposed within said elongated internal chamber of said housing and having a right hand spiral;

(ii) a second section connected to said first section and having a left hand spiral, said second section being disposed within said elongated internal chamber of said housing;

(d) a first carrier means for interconnection with the first curtain panel, said first carrier means comprising a first carrier assembly slidably connected to said elongated tracks said first carrier assembly comprising:

(i) a spiral engaging finger including a shank portion and a head portion for engagement with said spiral of said first section; and (ii) finger operated means for moving said head portion of said spiral engaging finger out of engagement with said spiral of said first section; and (e) a second carrier means for interconnection with the second curtain panel, said second carrier means comprising a second carrier assembly comprising;

(i) a spiral engaging finger including a shank portion and a first head portion for engagement with said spiral of said first section and a second head portion; and (ii) finger operated means for moving said head portion of said spiral engaging finger out of engagement with said spiral of said second section; and (f) control means for energizing and de-energizing said electric motor.

2. An apparatus as defined in claim 1 in which each of said finger operated means of said first and second carrier assemblies comprises:

(a) a body having a bore for slidably receiving said shank portion of said spiral engaging finger, said body including an upper, track engaging portion and a lower portion;

(b) a finger grip segment connected to said spiral engaging finger for moving said finger between a first position and a second extended position;

(c) biasing means carried by said body for yieldably resisting movement of said finger toward said second position; and (d) curtain connector interconnectable with one of the curtain panel.

3. An apparatus for drawing together first and second curtain panels comprising:

(a) an elongated support including an elongated track;

(b) an electric motor connected to said support;

(c) an elongated operating assembly connected to said electric motor for rotation thereby, said operating assembly comprising:

(i) a first section including a right hand spiral comprising a plurality of interconnected segments, each said segment including an external surface having at least a portion of a helix formed thereon; and (ii) a second section connected to said first section and including a left hand helix, said second section comprising a plurality of interconnected segments, each said segment including an external surface having at least a portion of a helix formed thereon;

(d) a first carrier means for interconnecting with the first curtain panel, said first carrier means comprising a first carrier assembly slidably connected to said elongated tracks, said first carrier assembly including a helix engaging finger in engagement with said right hand helix of said first section; and (e) a second carrier means connected to the second curtain panel, said second carrier means comprising a second carrier assembly including a helix engaging finger in engagement with said left hand helix of said second section.

4. An apparatus as defined in claim 3 further including a plurality of curtain connectors interconnectable with the curtain panels, said curtain connectors being connected to said track for sliding movement therealong by said first and second carrier means.

5. An apparatus as defined in claim 3 in which said elongated support comprises a housing having an internal chamber for enclosing therewithin said operating assembly.

6. An apparatus as defined in claim 3 further including means for energizing said electric motor from a location remote to said electric motor.

7. An apparatus as defined in claim 3 in which each of said first and second sections of said operating assembly comprises and elongated rod having an external surface, said helix being formed on said external surface.

8. An apparatus for drawing together first and second curtain panels comprising:

(a) an elongated support including an elongated track;

(b) an electric motor connected to said support;

(c) an elongated operating assembly connected to said electric motor for rotation thereby, said operating assembly comprising:

(i) a first section including a right hand spiral; and (ii) a second section connected to said first section and including a left hand helix;

(d) a first carrier means for interconnecting with the first curtain panel, said first carrier means comprising a first carrier assembly slidably connected to said elongated tracks, said first carrier assembly including a helix engaging finger in engagement with said right hand spiral of said first section, said first carrier assembly further comprising:

(i) a body having a bore for slidably receiving said helix engaging finger, said body including an upper track engaging portion and a lower portion;

(ii) a finger grip segment connected to said helix engaging finger for movement thereof between a first position and a second extended position; and (iii) biasing means carried by said body for yieldably resisting movement of said finger grip segment between said first and second positions; and (e) a second carrier means connected to the second curtain panel, said second carrier means comprising a second carrier assembly including a helix engaging finger in engagement with said left hand helix of said second section, said second carrier assembly further comprising:

(i) a body having a bore for slidably receiving said helix engaging finger, said body including an upper track engaging portion and a lower portion;

(ii) a finger grip segment connected to said helix engaging finger for movement thereof between a first position and a second extended position; and (iii) biasing means carried by said body for yieldably resisting movement of said finger grip segment between said first and second position.

9. An apparatus for drawing together first and second curtain panels comprising:

(a) an elongated support including an elongated track;

(b) an electric motor connected to said support;

(c) an elongated operating assembly connected to said electric motor for rotation thereby, said operating assembly comprising:

(i) a first section including a right hand spiral and comprising an elongated rod having an external surface having a helix formed thereon;

(ii) a second section connected to said first section and including an elongated rod having an external surface and a left hand helix formed on said external surface;

(d) a first carrier means for interconnecting with the first curtain panel, said first carrier means comprising a first carrier assembly slidably connected to said elongated tracks, said first carrier assembly including a helix engaging finger in engagement with said right hand spiral of said first section and comprising a plurality of interconnected segments, each said segment having an external surface having at least a portion of a helix formed thereon; and (e) a second carrier means connected to the second curtain panel, said second carrier means comprising a second carrier assembly including a helix engaging finger in engagement with said left hand helix of second section, and comprising a plurality of interconnected segments, each said segment having an external surface having at least a portion of a helix formed thereon.

10. An apparatus as defined in claim 9 in which each said segment comprises:

(a) a generally cylindrically shaped body portion having a central bore formed therein; and (b) a neck portion having outwardly extending locking elements formed thereon.

11. An apparatus for drawing together first and second curtain panels comprising:

(a) an elongated housing having a chamber and an elongated track;

(b) an elongated operating assembly disposed within said chamber and comprising:

(i) a first rod section including an external surface having a right hand helix formed thereon and comprising a plurality of interconnected segments, each said segment including an external surface having at least a portion of a helix formed thereon;

(ii) a second rod section including an external surface having a left hand helix formed thereon and comprising a plurality of interconnected segments, each said segment including an external surface having at least a portion of a helix formed thereon; and (iii) a connector interconnecting said first and second rod sections;

(b) drive means connected to one of said first and second rod sections for driving said rod section alternately in a clockwise direction and in a counter clockwise direction;

(c) a first carrier means interconnected with the first curtain panel, said first carrier means comprising a first carrier assembly slidably connected to said elongated track, said first carrier assembly including a helix engaging finger in engagement with said right hand helix formed on said external surface of said first rod section; and (d) a second carrier means interconnected with the second curtain panel, said second carrier means comprising a second carrier assembly slidably connected to said elongated track and including a helix engaging finger in engagement with said left hand helix formed on said external surface of said second rod section.

12. An apparatus as defined in claim 11 further including a plurality of curtain connectors interconnectable with said curtain panels, said curtain connectors being connected to said track for sliding movement there along by said first and second carrier means.

13. An apparatus as defined in claim 11 in which said elongated support comprises a housing having an internal chamber for enclosing therewithin said first and second rod sections of said operating assembly.

14. An apparatus as defined in claim 11 in which said drive means comprises an electric motor.

15. An apparatus as defined in claim 14 in which said drive means comprises remote key-control means for energizing said electric motor from a location remote to said electric motor.

16. An apparatus for drawing together first and second curtain panels comprising:

(a) an elongated housing having a chamber and an elongated track;

(b) an elongated operating assembly disposed within said chamber and comprising:

(i) a first rod section including an external surface having a right hand helix formed thereon;

(ii) a second rod section including an external surface having a left hand helix formed thereon; and (iii) a connector interconnecting said first and second rod sections;

(b) drive means connected to one of said first and second rod sections for driving said rod section alternately in a clockwise direction and in a counter clockwise direction;

(c) a first carrier means interconnected with the first curtain panel, said first carrier means comprising a first carrier assembly slidably connected to said elongated track, said first carrier assembly including a helix engaging finger in engagement with said right hand helix formed on said external surface of said first rod section, said first carrier assembly further comprising:

(i) a body having a bore for slidably receiving said helix engaging finger, said body including an upper track engaging portion, and a lower portion;

(ii) a finger grip segment connected to said helix engaging finger for movement thereof between a first position and a second extended position; and (iii) biasing means carried by said body for yieldably resisting movement of said finger grip segment between said first and second position; and (d) a second carrier means interconnected with the second curtain panel, said second carrier means comprising a second carrier assembly slidably connected to said elongated track and including a helix engaging finger in engagement with said left hand helix formed on said external surface of said second rod section, said second carrier assembly further comprising:

(i) a body having bore for slidably receiving said helix engaging finger, said body including an upper track engaging portion and a lower portion;

(ii) a finger grip segment connected to said helix engaging finger for movement thereof between a first position and a second extended position; and (iii) biasing means carried by said body for yieldably resisting movement of said finger grip segment between said first and second positions.

* * * * *